US007912708B2

(12) United States Patent
Gigi

(10) Patent No.: US 7,912,708 B2
(45) **Date of Patent: *Mar. 22, 2011**

(54) METHOD FOR CONTROLLING DURATION IN SPEECH SYNTHESIS

(75) Inventor: Ercan Ferit Gigi, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 796 days.

This patent is subject to a terminal disclaimer.

(21) Appl. No.: 10/527,779

(22) PCT Filed: Aug. 5, 2003

(86) PCT No.: PCT/IB03/03360

§ 371 (c)(1),
(2), (4) Date: Mar. 14, 2005

(87) PCT Pub. No.: WO2004/027758

PCT Pub. Date: Apr. 1, 2004

(65) Prior Publication Data

US 2006/0004578 A1 Jan. 5, 2006

(30) Foreign Application Priority Data

Sep. 17, 2002 (EP) ..... 02078847

(51) Int. Cl.
*G10L 11/04* (2006.01)

(52) U.S. Cl. ..... 704/207; 704/211; 704/208; 704/258; 704/267

(58) Field of Classification Search ..... 704/211, 704/207, 208, 214, 220, 258, 267
See application file for complete search history.

(56) References Cited

U.S. PATENT DOCUMENTS

| | | | | |
|---|---|---|---|---|
| 5,189,702 | A | 2/1993 | Sakurai et al. | |
| 5,479,564 | A | 12/1995 | Vogten et al. | |
| 5,729,657 | A | 3/1998 | Svensson | |
| 5,787,398 | A * | 7/1998 | Lowry | 704/268 |
| 5,832,437 | A * | 11/1998 | Nishiguchi et al. | 704/268 |
| 5,884,253 | A * | 3/1999 | Kleijn | 704/223 |
| 6,208,960 | B1 | 3/2001 | Gigi | |
| 6,324,501 | B1 | 11/2001 | Stylianou et al. | |
| 6,963,833 | B1 * | 11/2005 | Singhal | 704/207 |
| 2001/0023396 | A1 * | 9/2001 | Gersho et al. | 704/220 |

FOREIGN PATENT DOCUMENTS

| | | | |
|---|---|---|---|
| EP | 0363233 | A1 | 4/1990 |
| EP | 0363233 | B1 | 11/1994 |

(Continued)

OTHER PUBLICATIONS

Eric Moulines e tal. "Pitch-Synchronous Waveform Processing Techniques for Text-To-Speech Synthesis Using Diphones" , Speech Commun., vol. 9, pp. 453-467, 1990.

*Primary Examiner* — Vijay B Chawan

(57) ABSTRACT

The present invention relates to a method of synthesizing of a speech signal, comprising: —assigning of a first identifier to a first class of intervals of an original speech signal and assigning of a second identifier to a second class of intervals of the original speech signal, —windowing the original speech signal to provide a number of pitch bells, —processing the pitch bells having the first identifier assigned thereto for modifying a duration of the speech signal, —performing an overlap and add operation on the processed pitch bells.

14 Claims, 3 Drawing Sheets

FOREIGN PATENT DOCUMENTS

| | | | |
|---|---|---|---|
| EP | 0706170 | A2 | 4/1996 |
| EP | 0706170 | A3 | 11/1997 |
| JP | 63199399 | A | 8/1988 |
| JP | 1093795 | A | 4/1989 |
| JP | 2001513225 | A | 8/2001 |
| JP | 2001350500 | A | 12/2001 |

* cited by examiner

METHOD FOR CONTROLLING DURATION IN SPEECH SYNTHESIS

Present invention relates to the field of speech processing, and more particularly without limitation, to the field of text-to-speech synthesis.

The function of a text-to-speech (TTS) synthesis system is to synthesize speech from a generic text in a given language. Nowadays, TTS systems have been put into practical operation for many applications, such as access to databases through the telephone network or aid to handicapped people. One method to synthesize speech is by concatenating elements of a recorded set of subunits of speech such as demi-syllables or polyphones. The majority of successful commercial systems employ the concatenation of polyphones. The polyphones comprise groups of two (diphones), three (triphones) or more phones and may be determined from nonsense words, by segmenting the desired grouping of phones at stable spectral regions. In a concatenation based synthesis, the conversation of the transition between two adjacent phones is crucial to assure the quality of the synthesized speech. With the choice of polyphones as the basic subunits, the transition between two adjacent phones is preserved in the recorded subunits, and the concatenation is carried out between similar phones. Before the synthesis, however, the phones must have their duration and pitch modified in order to fulfil the prosodic constraints of the new words containing those phones. This processing is necessary to avoid the production of a monotonous sounding synthesized speech. In a TTS system, this function is performed by a prosodic module. To allow the duration and pitch modifications in the recorded subunits, many concatenation based TTS systems employ the time-domain pitch-synchronous overlap-add (TD-PSOLA) (E. Moulines and F. Charpentier, "Pitch synchronous waveform processing techniques for text-to-speech synthesis using diphones," Speech Commun., vol. 9, pp. 453-467, 1990) model of synthesis. In the TD-PSOLA model, the speech signal is first submitted to a pitch marking algorithm. This algorithm assigns marks at the peaks of the signal in the voiced segments and assigns marks 10 ms apart in the unvoiced segments. The synthesis is made by a superposition of Hanning windowed segments centered at the pitch marks and extending from the previous pitch mark to the next one. The duration modification is provided by deleting or replicating some of the windowed segments. The pitch period modification, on the other hand, is provided by increasing or decreasing the superposition between windowed segments.

Despite the success achieved in many commercial TTS systems, the synthetic speech produced by using the TD-PSOLA model of synthesis can present some drawbacks, mainly under large prosodic variations, outlined as follows.

Examples of such PSOLA methods are those defined in documents EP-0363233, U.S. Pat. No. 5,479,564, EP-0706170. A specific example is also the MBR-PSOLA method as published by T. Dutoit and H. Leich, in Speech Communications, Elsevier Publisher, November 1993. U.S. Pat. No. 5,479,564 suggests a means of modifying the frequency of an audio signal with constant fundamental frequency by overlap-adding short-term signals extracted from this signal. The length of the weighting windows used to obtain the short-term signals is approximately equal to two times the period of the audio signal and their position within the period can be set to any value (provided the time shift between successive windows is equal to the period of the audio signal). Document U.S. Pat. No. 5,479,564 also describes a means of interpolating waveforms between segments to concatenate so as to smooth out discontinuities.

Such PSOLA methods enable to modify the duration of a given speech signal. This is done by repeating or deleting pitch bells before an overlap and add operation is performed for the speech synthesis. The information in a pitch bell is not always suitable for repetition like in a plosive sound. It is a common disadvantage of prior art PSOLA methods that artefacts are introduced this way. These artefacts can lead to a metallic sound of the synthesized speech signal and can even seriously affect or destroy the intelligibility of the synthesized signal.

The present invention therefore aims to provide an improved method for processing of a speech signal.

The present invention provides a method, a computer program product and a computer system for processing of a speech signal. In essence, the present invention enables to synthesize a natural sounding synthesized speech signal with improved intelligibility.

This is accomplished by classifying certain intervals contained in the original speech signal. In accordance with a preferred embodiment of the invention 'steady' and 'dynamic' intervals are identified within the original speech signal. This classification needs to be performed only once. It is utilized for synthesizing a speech signal based on the original speech signal with a modified duration.

The present invention is based on the observation that the repetition of pitch bells form dynamic intervals, as it is done in prior art PSOLA methods, introduces an unintentional periodicity which leads to artefacts, such as a metallic sounding synthesized signal, and to reduced or destroyed intelligibility.

In accordance with the present invention this problem is solved by restricting the processing of pitch bells for the purpose of duration modification to pitch bells of steady intervals of the original speech signal. In other words duration modifications are only performed on those speech intervals which can have different durations. This is true for the middle of a vowel or a consonant like the /s/ sound. But there are cases where local events occur that last less than a single period. These are sudden changes like the start of an unvoiced plosive (/p/, /t/, /k/) or the ticks and clicks produced by the tongues and the mouth (/b/, /d/, /g/, /l/, /m/, /n/, etc.). Periods containing these events are important for intelligibility and should not be omitted by manipulation. Repeating them is also a problem since this introduces artefacts that sound unnatural. Also the periods at the start of a transition from an unvoiced sound to a vowel have local features that should not be made longer or shorter. To avoid artefacts, all periods are marked with a special period class-type information. This information is used to determine whether a period can be repeated or omitted. Hence, pitch bells which are obtained by windowing of dynamic intervals of the original speech signal are not repeated for duration modification. Pitch bells which are obtained from intervals which are classified as dynamic and of being essential for the intelligibility are kept in the synthesized signal in order to maintain intelligibility. Pitch bells which are obtained by windowing of intervals of the original speech signal which are classified as dynamic but as not being essential for intelligibility may or may not be deleted before performing the overlap and add operation without seriously affecting the quality of the resulting synthesized speech signal.

A preferred application of the present invention is for text-to-speech systems which store a large number of natural speech recordings which are modified in the process of text-to-speech synthesis.

In accordance with a preferred embodiment of the invention a raised cosine window is used for the windowing of the speech signal. Preferably a sine window is used for steady intervals containing unvoiced speech. The pitch bells obtained for such steady intervals containing unvoiced speech are randomized in order to remove any unintended periodicity which can be introduced in the process of duration modification.

In the following preferred embodiments of the invention will be described in greater detail by making reference to the drawings in which.

Figure 1:
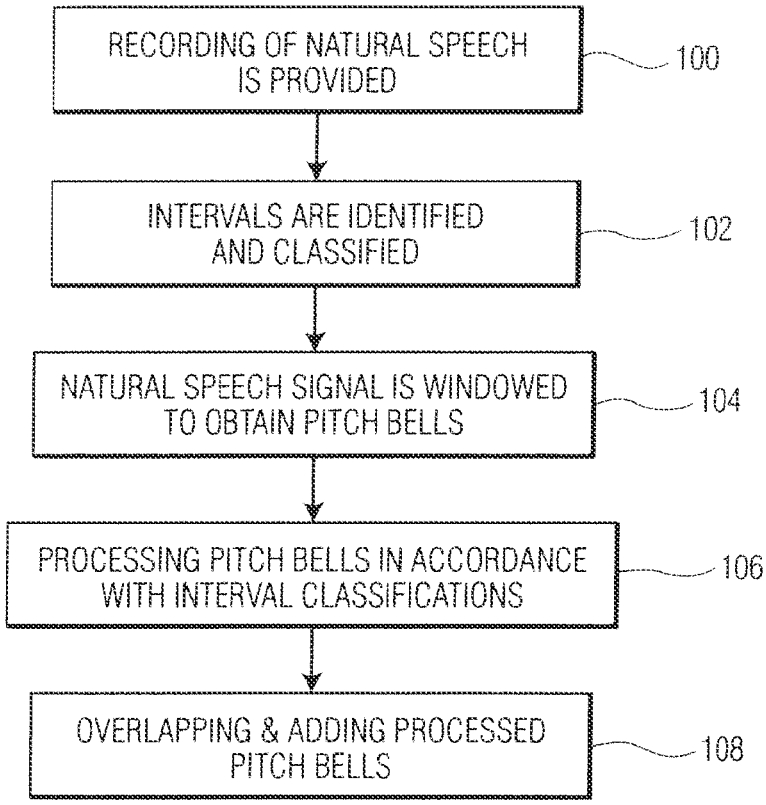
FIG. 1 is illustrative of a flow chart of a preferred embodiment of the present invention.

FIG. 1 shows a flow diagram to illustrate a preferred embodiment of a method of the invention. In step 100 a recording of natural speech is provided. In step 102 intervals in the natural speech recording are identified and classified. For the classification of the speech intervals the following classification system is used in the example considered here:

| | |
|---|---|
| — | silence |
| • | unvoiced period |
| v | voiced period |
| p | crucial dynamic unvoiced period (should only be used once) |
| b | crucial dynamic voiced period (should only be used once) |
| q | dynamic unvoiced period (may only be used once) |
| c | dynamic voiced period (may only be used once) |

The two basic categories of speech intervals are 'steady' and 'dynamic' speech intervals. A speech interval is classified as 'steady' when it has an essentially constant signal characteristic for a consecutive number of at least two periods of the fundamental frequency of the natural speech signal. In contrast the speech interval of the original speech recording is classified as 'dynamic' when it's signal characteristic only occurs within one period of the fundamental frequency.

In the classification system considered here the '.' and 'v' periods are steady periods. The 'p', 'b', 'q' and 'c' periods are dynamic periods which are treated differently in the subsequent processing.

In step 104 the natural speech signal is windowed to obtain pitch bells. Preferably the windowing is performed by means of a raised cosine window or with a sine window for the '.' periods.

In step 106 the pitch bells which are obtained for periods which are classified as 'steady' are processed in order to modify the duration of the speech signal. This can be done by repeating or deleting of pitch bells to increase or decrease the original duration, respectively. Pitch bells which are obtained from periods which are classified as 'dynamic' are not repeated in order to avoid the introduction of artifacts. Pitch bells which have been obtained from periods which are classified as 'p' or 'b' can not be deleted in order to maintain the intelligibility of the original signal. Pitch bells which are obtained for periods which are classified as 'q' or 'c' are also not repeated, but can be deleted without seriously effecting the intelligibility of the resulting synthesized signal.

Preferably pitch bells for periods which are classified as '.' are obtained in a randomized way in order to avoid the introduction of periodicity. This is further helped by the usage of a sine window for the windowing of those periods.

In step 108 the processed pitch bells are overlapped and added in order to obtain the synthesized signal.

Figure 2:
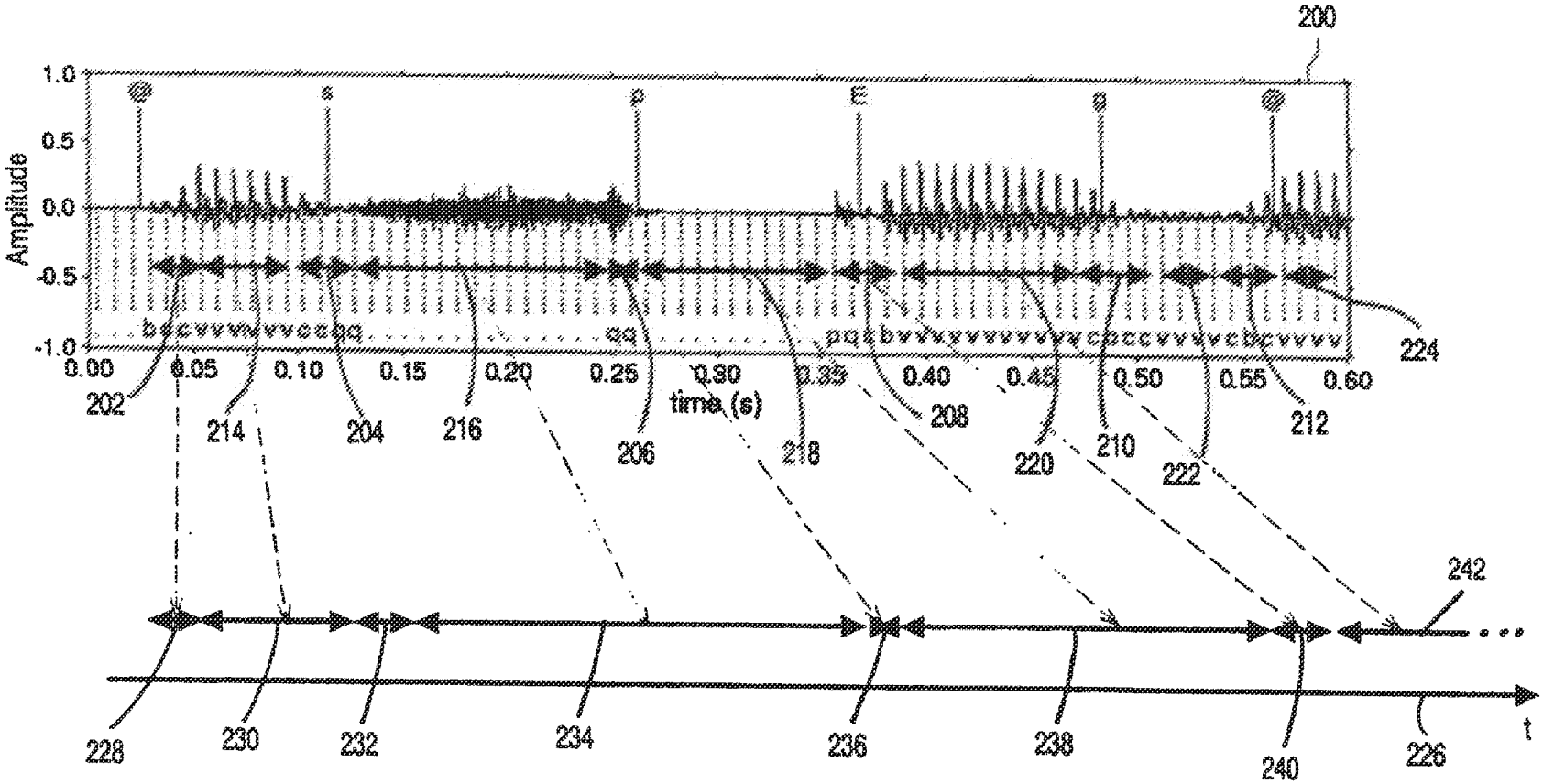
FIG. 2 is illustrative of the synthesis of a speech signal based on an original speech signal in accordance with an embodiment of the present invention.

FIG. 2 is illustrative of an example for the processing of a natural speech signal 200. The natural speech signal 200 has dynamic intervals 202, 204, 206, 208, 210 and 212. The dynamic interval 202 contains periods which are classified as 'b', 'c'. The dynamic interval 204 contains periods which are classified as 'c', 'q'. The dynamic interval 206 contains periods which are classified as 'q'. The dynamic interval 208 contains periods which are classified as 'q', 'c' and 'b'. The dynamic interval 210 contains periods which are classified as 'c', 'b'. Finally the dynamic interval 212 contains periods which are classified as 'c' and 'b'. Further the natural speech signal 200 contains steady intervals 214, 216, 218, 220, 222 and 224. The steady interval 214 contains periods which are classified as 'v'; the steady interval 216 contains periods which are classified as '.'; the steady interval 218 contains periods which are classified as '.'; the steady interval 220 contains periods which are classified as 'v'; the steady interval 222 contains periods which are classified as 'v' and the steady interval 224 contains periods which are classified as 'v'. This classification can be performed either manually or automatically by means of an appropriate signal analysis program. Preferably an automatic analysis is performed by means of such a program which is then controlled by a human expert and manually corrected, if necessary. It is to be noted that this classification needs to be performed only once in order to enable an unlimited number of signal syntheses.

In the example considered here a signal is to be synthesized based on the natural speech signal 200 which has an extended duration as compared to the original speech signal 200. For this purpose the natural speech signal 200 is windowed by means of a window positioned synchronously with the fundamental frequency of the natural speech signal 200 as it as such known from the prior art and used in PSOLA type methods.

Preferably a raised cosine is used as window. For periods which are classified as '.' a sine window is used in order to reduce unintended periodicity which may be introduced when pitch bells of the noisy signal portion are repeated. As a further measure against unintended periodicity the pitch bells for the '.' classified periods are acquired in a randomized way. In the example considered here the signal to be synthesized is composed as follows in the domain of the time axis 226:

The first interval 228 of the speech signal to be synthesized contains the pitch bells from the dynamic interval 202. These pitch bells are used for the interval 228 without modification which implies that the duration of the interval 228 is unchanged with respect to the dynamic interval 202. The duration of the interval 230 is about twice the duration of the corresponding steady interval 214. This is accomplished by repeating each of the pitch bells acquired for the steady interval 214. Interval 232 contains the pitch bells from the dynamic interval 204. The duration of 232 is unchanged as compared to the dynamic interval 204. Interval 234 is constituted by pitch bells acquired from steady interval 216. Again each of the pitch bells contained in the steady interval 216 is repeated in order to double the duration of this interval. Likewise the following intervals 236, 238, 240, 242, . . . are obtained from the intervals 206, 218, 208, 220, 210, 222, 212, 242. Next the pitch bells are overlapped in the domain of the time axis 226 in order to obtain the resulting synthesized signal. Alternatively the pitch bells obtained from the periods of the natural speech signal 200 which are classified as 'q' or 'c' can be deleted. In any case none of the pitch bells which are obtained from periods of the natural speech signal 200 which are classified as 'dynamic' are repeated. This way a duration modification can be performed without introducing artifacts which would otherwise seriously impact the quality and intelligibility of the synthesized signal.

In the example considered here 'p' is used to mark local (unvoiced) events that are crucial for the intelligibility of the spoken utterance. Usually, the noise burst after the release of air by the mouth or the tongue is of this type. The phonemes /p/, /t/ and /k/ have at least one such period. Periods marked with 'p' should appear only once at the synthesized speech, regardless of the final duration of the phoneme. Some local (unvoiced) events are not crucial for intelligibility but are so dynamic that repeating them would introduce a series of unnatural sounding periods. These periods are marked with the letter 'q'. They may only be used once, but they can also be omitted without a major degradation in quality or intelligibility. The voiced counterparts for 'p' and 'q' are the types denoted by 'b' and 'c'. The voiced plosives /b/, /d/ and /g/ usually have at least one period marked with 'b'. Also the tongue can produce tick and click sounds when it hits or leaves other parts of the mouth. The phoneme /l/ is an example where this can happen. The transition from silence to vowels or from unvoiced consonants to vowels also have periods with local events. Although the periods in the middle of a vowel can be repeated many times without affecting the naturalness, the periods that fall right in the middle of the transition are too dynamic for repetition.

Figure 3:
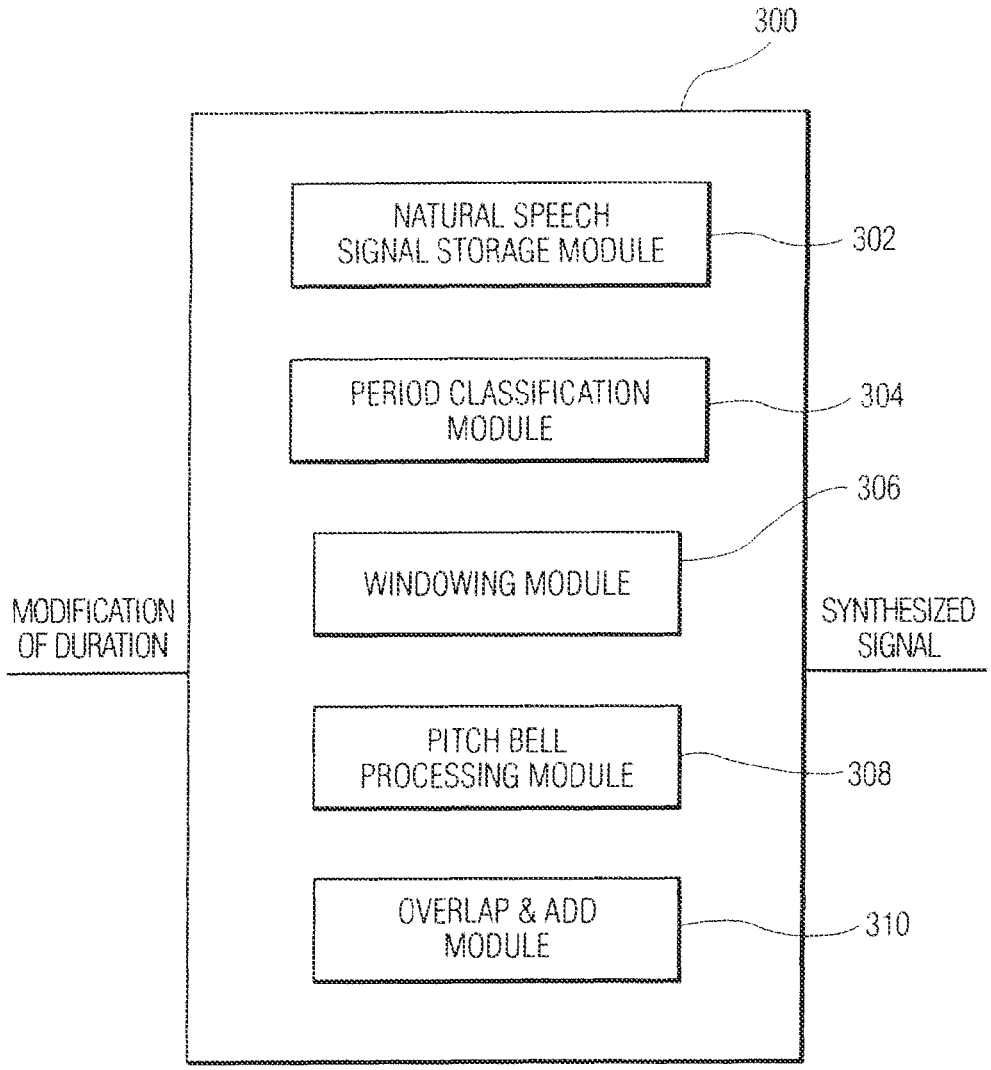
FIG. 3 is a block diagram of an embodiment of a computer system of the invention.

FIG. 3 shows a block diagram of an embodiment of a computer system of the invention. Preferably the computer system is a text-to-speech system which embodies the principles of the present invention. The computer system 300 has a module 302 which serves to store natural speech signals. Module 304 serves to automatically, manually or interactively classify periods of the natural speech signals stored in the module 302. Module 306 serves to perform the windowing of a natural speech signal stored in the module 302. This way a number of pitch bells are obtained. Module 308 serves for pitch bell processing. The pitch bell processing for duration modification is only performed on pitch bells which are obtained from intervals which are classified as steady. In addition pitch bells from dynamic intervals which are classified as not being essential for the intelligibility can be deleted by module 308, such that they do not occur in the synthesized signal. Module 310 serves to perform an overlap and add operation of the resulting pitch bells in order to obtain the synthesized signal. The desired modification of the duration of the original natural speech signal stored in module 302 is inputted into the computer system 300. The resulting synthesized signal is outputted from the computer system 300 on a carrier wave or as a data file.

LIST OF REFERENCE NUMERALS:

| | |
|---|---|
| 200 | natural speech signal |
| 202 | dynamic interval |
| 204 | dynamic interval |
| 206 | dynamic interval |
| 208 | dynamic interval |
| 210 | dynamic interval |
| 212 | dynamic interval |
| 214 | steady interval |
| 216 | steady interval |
| 218 | steady interval |
| 220 | steady interval |
| 222 | steady interval |
| 224 | steady interval |
| 226 | time axis interval |
| 230 | interval |
| 232 | interval |
| 234 | interval |

-continued

LIST OF REFERENCE NUMERALS:

| | |
|---|---|
| 236 | interval |
| 238 | interval |
| 240 | interval |
| 242 | interval |
| 300 | computer system |
| 302 | module |
| 304 | module |
| 306 | module |
| 308 | module |
| 310 | module |

The invention claimed is:

1. A method of synthesizing of a speech signal using processing apparatus, comprising:

the processing apparatus automatically assigning of a first identifier to a first class of steady intervals of an original speech signal and assigning of a second identifier to a second class of dynamic intervals of the original speech signal, the processing apparatus automatically windowing the original speech signal to provide a number of pitch bells, the processing apparatus automatically processing the pitch bells having the first identifier assigned thereto for modifying a duration of the speech signal, and the processing apparatus automatically performing an overlap and add operation on the processed pitch bells the processing apparatus outputting the overlapped and added pitch bells as a synthesized speech signal.

2. The method of claim 1, wherein the first identifier is selected between a first code and a second code, the first code being indicative of an unvoiced interval and the second code being indicative of a voiced interval.

3. The method of claim 1, whereby the second identifier is selected between a third code, a fourth code, a fifth code and a sixth code, the third code being indicative of an unvoiced interval being essential for the intelligibility of the speech signal, the fourth code being indicative of a voiced interval being essential for the intelligibility of the speech signal, and the fifth code being indicative of an unvoiced interval not being essential for the intelligibility of the speech signal and the sixth code being indicative of a voiced interval not being essential for the intelligibility of the speech signal.

4. The method of claim 3 wherein pitch bells being assigned to the fifth or sixth code are at some times deleted and at other times not deleted.

5. The speech signal of claim 1 wherein one or more pitch bells belonging to a dynamic voice or unvoiced interval have been deleted prior to the overlap and add operation.

6. The method of claim 1 wherein a raised cosine is used for windowing of the speech signal.

7. The method of claim 1, wherein a sine window is used for windowing of steady, unvoiced intervals of the speech signal.

8. The methods of claim 1, comprising randomizing the pitch bells of steady, unvoiced periods before performing the overlap and add operation.

9. The method of claim 1, wherein the windowing is performed by means of a logical window positioned synchronously with a fundamental frequency of the speech signal.

10. A synthesized speech signal output by the method of claim 1, and embodied as physical variations of properties of a computer detectable media.

11. A text-to-speech computer system, comprising:

means for storing of a speech signal, means for storing of first identifiers being assigned to a first class of steady intervals of an original speech signal and for storing of a second identifiers being assigned to a second class of dynamic intervals of the original speech signal, means for logically windowing the speech signal to provide a number of pitch bells, means for processing the pitch bells having the first identifier assigned thereto for modifying a duration of the speech signal, means for performing an overlap and add operation on the processed pitch bells, means for outputting the overlapped and added pitch bells as a synthesized speech signal.

12. The speech signal of claim 11 wherein one or more pitch bells belonging to a dynamic voice or unvoiced interval have been deleted prior to the overlap and add operation.

13. A synthesized speech signal output by the text-to-speech system of claim 11, and embodied as physical variations of properties of a computer detectable media.

14. The synthesized speech signal of claim 13 wherein the media is a computer memory in which the synthesized speech signal is stored.

* * * * *